US009877564B2

(12) United States Patent
Kim et al.

(10) Patent No.: US 9,877,564 B2
(45) Date of Patent: Jan. 30, 2018

(54) LIQUID CONTENT CONTAINER COMPRISING TENSION MEMBER

(71) Applicant: AMOREPACIFIC CORPORATION, Seoul (KR)

(72) Inventors: Joonyoung Kim, Seoul (KR); Jeongin Lee, Seoul (KR); Juho Kim, Seoul (KR)

(73) Assignee: AMOREPACIFIC CORPORATION, Cheonggyecheon-Ro, Jung-Gu, Seoul (KR)

( * ) Notice: Subject to any disclaimer, the term of this patent is extended or adjusted under 35 U.S.C. 154(b) by 0 days.

(21) Appl. No.: 15/030,561

(22) PCT Filed: Oct. 16, 2014

(86) PCT No.: PCT/KR2014/009754

§ 371 (c)(1),
(2) Date: Apr. 19, 2016

(87) PCT Pub. No.: WO2015/060582

PCT Pub. Date: Apr. 30, 2015

(65) Prior Publication Data

US 2016/0249727 A1 Sep. 1, 2016

(30) Foreign Application Priority Data

Oct. 21, 2013 (KR) ..... 20-2013-0008639 U

(51) Int. Cl.
*A61B 17/20* (2006.01)
*A45D 40/06* (2006.01)
(Continued)

(52) U.S. Cl.
CPC ..... *A45D 34/04* (2013.01); *A45D 2200/055* (2013.01)

(58) Field of Classification Search
CPC .. A45D 34/04; A45D 33/06; A45D 2200/055; B65D 83/76; B65D 47/42; A46B 5/0033; B26B 21/08
(Continued)

(56) References Cited

U.S. PATENT DOCUMENTS 3,095,598 A * 7/1963 Gonnella ..... A45D 34/041 401/213
4,359,292 A * 11/1982 Thompson ..... B65D 47/42 401/213
(Continued)

FOREIGN PATENT DOCUMENTS

KR 10-0828417 B1 5/2008
KR 100828417 B1 * 5/2008
(Continued)

*Primary Examiner* — Allana Lewin Bidder
*Assistant Examiner* — Thomas M Abebe
(74) *Attorney, Agent, or Firm* — Lucem, PC; Heedong Chae

(57) ABSTRACT

The present invention relates to a liquid content container comprising a tension member, comprising: a container body (10) for accommodating content; an adaptor (40) provided at the upper end of the container body (10); a shoulder member (50) coupled to the upper end of the container body (10); the tension member (60) provided at the shoulder member (50); a distributing member (70) coupled to the shoulder member (50); and the discharge member (80) coupled to the distributing member (70).

9 Claims, 6 Drawing Sheets

(51) Int. Cl.

| | |
|---|---|
| ***A45D 33/02*** | (2006.01) |
| ***A45D 34/04*** | (2006.01) |
| ***A45D 40/04*** | (2006.01) |
| ***A45D 40/26*** | (2006.01) |
| ***A45D 40/02*** | (2006.01) |
| ***B25G 3/38*** | (2006.01) |

(58) Field of Classification Search
USPC ..... 401/465, 208, 209, 213–216, 172–175
See application file for complete search history.

(56) References Cited

U.S. PATENT DOCUMENTS 4,723,860 A * 2/1988 Giblin ..... A45D 34/041 401/206
4,932,803 A * 6/1990 Goldberger ..... A45D 40/04 222/390
5,000,356 A * 3/1991 Johnson ..... A45D 40/04 222/340
5,248,213 A * 9/1993 Seager ..... A45D 34/041 215/231
5,802,658 A * 9/1998 Ward ..... A46B 7/02 15/144.2
6,422,778 B2 * 7/2002 Baumann ..... A61B 17/20 401/134
6,450,722 B1 * 9/2002 Ruschke ..... A45D 40/04 264/231
6,890,115 B2 * 5/2005 Le Moing, II ..... A45D 40/02 132/293
7,344,328 B2 * 3/2008 McAuley ..... A45D 34/04 401/202
7,883,287 B2 * 2/2011 Thorpe ..... A45D 34/04 401/265
8,065,774 B2 * 11/2011 Schiesz ..... A46B 5/0075 15/143.1
9,125,472 B2 * 9/2015 Lin ..... A45D 33/06
9,504,305 B2 * 11/2016 Jung ..... A45D 40/26
2005/0214063 A1 * 9/2005 Weiss ..... A45D 40/26 401/266
2006/0045609 A1 * 3/2006 McAuley ..... A45D 34/04 401/206
2006/0285913 A1 * 12/2006 Koptis ..... A45D 40/26 401/205
2007/0217860 A1 * 9/2007 Byun ..... B65D 35/36 401/205
2008/0142036 A1 * 6/2008 Sanchez ..... A45D 34/04 132/320
2008/0264440 A1 * 10/2008 Thorpe ..... A45D 33/02 132/299
2009/0188518 A1 * 7/2009 Thorpe ..... A45D 33/003 132/307
2011/0250008 A1 * 10/2011 Lim ..... A45D 40/261 401/188 R
2012/0039656 A1 * 2/2012 Baines ..... A45D 40/04 401/68
2014/0286689 A1 * 9/2014 Jung ..... A45D 34/041 401/179
2015/0296957 A1 * 10/2015 Megaro ..... A45D 34/041 132/200
2016/0029770 A1 * 2/2016 Megaro ..... A45D 34/041 401/220
2016/0128457 A1 * 5/2016 Lim ..... A46B 5/0033 401/118
2016/0192763 A1 * 7/2016 Cheng ..... B65D 47/42 401/265

FOREIGN PATENT DOCUMENTS

KR 20-2009-0005974 U 6/2009
KR 20090005974 U * 6/2009
KR 10-2011-0126772 A 11/2011
KR 10-1159307 B1 6/2012
WO WO 2013032223 A2 * 3/2013 ..... A45D 40/18
WO WO 2013111932 A1 * 8/2013 ..... A45D 34/04

* cited by examiner

LIQUID CONTENT CONTAINER COMPRISING TENSION MEMBER

CROSS-REFERENCE TO RELATED APPLICATION

This application claims the benefit of Korean Application No. 20-2013-0008639, filed on Oct. 21, 2013 with the Korean Intellectual Property Office, the disclosure of which is incorporated herein by reference.

TECHNICAL FIELD

The present invention relates to a liquid content container having a tension member and more specifically, to a liquid content container having a tension member, enabling a user to conveniently make up as the tension member is provided under a discharge member such that the discharge member is moved at a predetermined angle in a container body.

BACKGROUND ART

Disclosure

In general, makeup is to stand out a beautiful portion of a human body and cover a weak portion of the human body. Accordingly, women put on facial makeup to express themselves more beautifully. In particular, the women put on color makeup as well as base makeup for skin care and beauty expression. Among color cosmetics, foundation is representatively used to cover skin flaws and to produce a makeup effect of the natural skin-tone, and mainly includes a powder-type foundation, a solid-type foundation, and a liquid-type foundation.

In the power-type foundation, powders may be scattered, and less stuck to the race of a user when being applied to the face of the user. The solid-type foundation may make the user feel the face dried, and be agglomerated, and the persistency of the sol id-type foundation may be degraded.

Recently, in order to solve the above problems, a liquid-type foundation has been developed to allow the user to feel fresh by providing a light feeling and a moist to the skin of the user, and the use of the liquid-type foundation is gradually increased due to the use convenience thereof.

Further, in order to use the liquid-type foundation, which is one of color cosmetics, a puff, which is a makeup tool, is additionally required.

Regarding a conventional liquid cosmetic container, a user discharges contents from the liquid cosmetic container and applies the contents to a required part with a hand of the user or the puff.

In the case of the conventional liquid cosmetic container, if the user makes up with the hand, the contents of the liquid cosmetic container may be contaminated, and the hand of the user may be sticky after makeup.

Alternatively, when the user uses the liquid foundation with the puff, the user must separately prepare the puff and apply the contents to the puff for the use of the contents, thereby causing the user to feel inconvenient.

In order to solve the above problem, the present applicant has suggested a liquid content container having a mixing member in which a puff is integrally formed with a container body having contents in Korean Utility Model Registration No. 20-2013-0002813.

However, when the user makes up using the liquid content container having the mixing member according to the related art, the user may feel inconvenient when making up using a discharge member fixed to the container body since the face of a human being has a curved and 3-D shape.

Technical Problem

An object of the present invention is to provide a liquid content container having a tension member, enabling a user to conveniently make up as the tension member is provided under a discharge member such that the discharge member is moved at a predetermined angle in a container body.

Another object of the present invention is to provide a liquid content container having a tension member, enabling a user to make up without contaminating fingers of the user with cosmetics.

Technical Solution

In order to accomplish the above objects, there is provided a liquid content container having a tension member. The liquid content container includes a container body (10) to receive contents therein, an adaptor (40) mounted on an upper end of the container body (10), a shoulder member (50) coupled to the upper end of the container body (10), a tension member (60) mounted on the shoulder member (50), a distribution member (70) coupled to the shoulder member (50), and a discharge member (80) coupled to the distribution member (70).

Preferably, the rotating member (20) is formed at a center thereof with a screw rod (22).

Preferably, the piston (30) is formed at the center thereof with a screw hole (32), and formed at an outer circumferential surface of a lower end thereof with a piston rib (34) to push up contents.

The shoulder member (50) is formed in a center thereof with a housing (58), and an opening and closing member (56) and an elastic member (57) are mounted in the housing (58).

The shoulder member (50) has a first mounting groove (55) formed at an outside of the housing (58).

The housing (58) is formed on an inner lower end thereof with a mounting step (52).

The shoulder member (50) is coupled to a container lid (100) through fitting.

The tension member (60) includes at least one of natural rubber, elastomer, silicon rubber, NBR rubber, and synthetic resin having excellent elasticity.

The tension member (60) is formed at the center thereof with a recess part (61).

The distribution member (70) is formed at a lower portion thereof with a tension guide (73), and the tension guide (73) is formed at a distal end thereof with a stopping protrusion (74).

The distribution member (70) is formed in a lower portion thereof with a second mounting groove (75).

The discharge member (80) includes a discharge hole (81) and a protruding ring (82).

A puff sheet (90) may be additionally provided at an outer circumferential surface of the upper end of the discharge member (80).

Advantageous Effects

As described above, according to the liquid content container having the tension member according to the present invention, the tension member is provided under the discharge member, so that the discharge member moves at a predetermined angle in the container body. Accordingly, the user can conveniently make lip.

In addition, according to the liquid content container having the tension member of the present invention, the user can make up without contaminating a hand of the user with cosmetics.

BEST MODE

Mode for Invention

Hereinafter, a liquid content container having a tension member according to one embodiment of the present invention will be described with reference to accompanying drawings.

Figure 1:
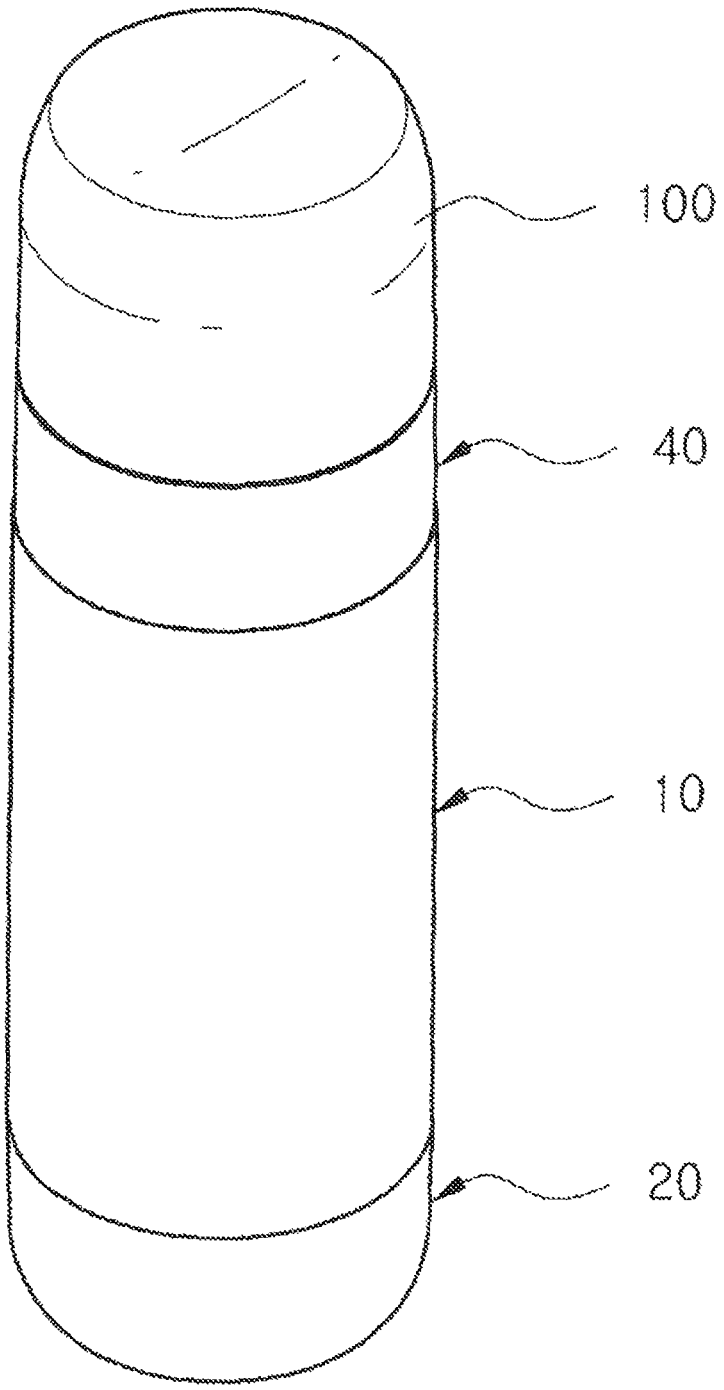
FIG. 1 is an assembling perspective view showing a liquid content container having a tension member according to the present invention.
Figure 2:
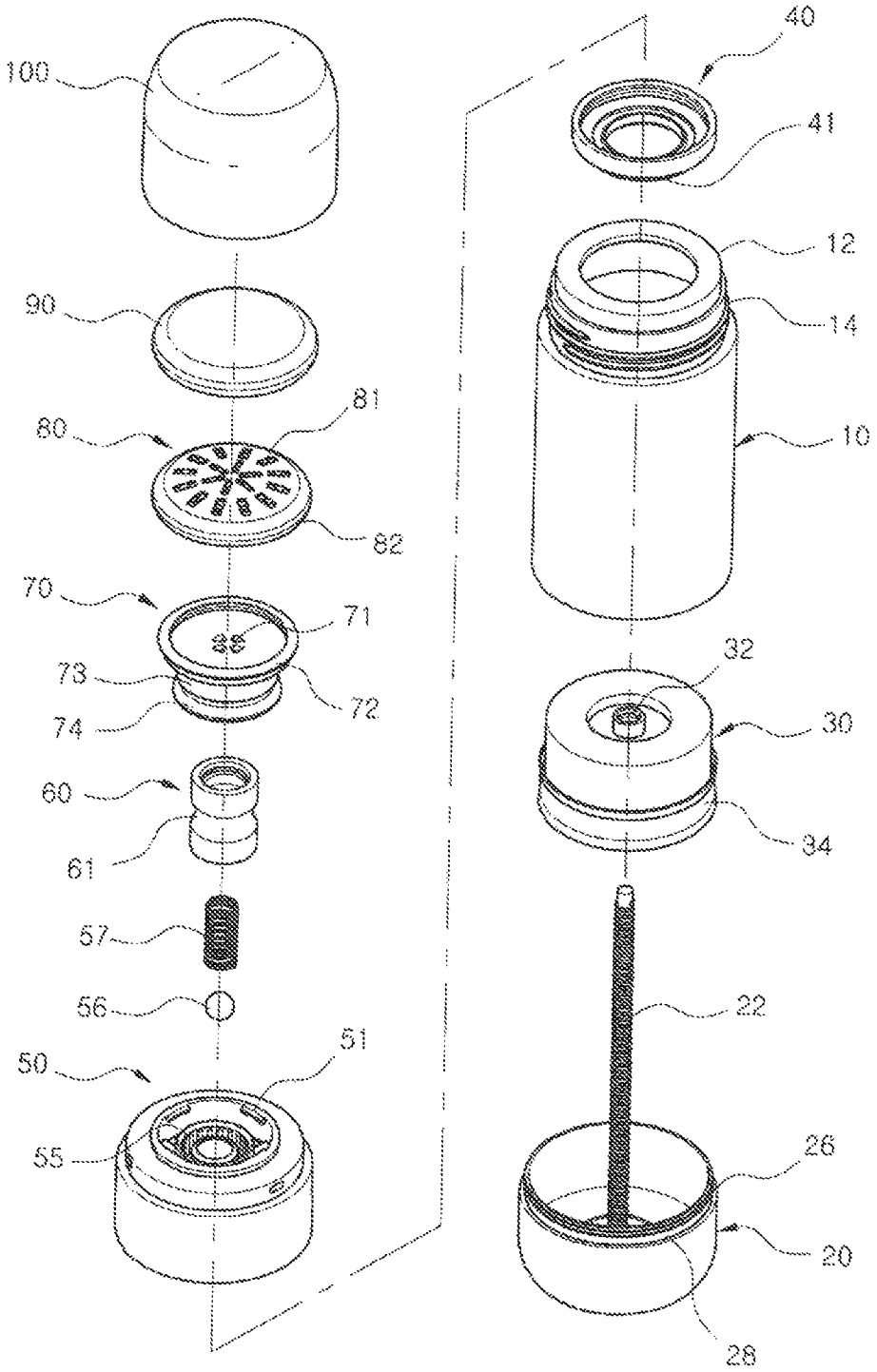
FIG. 2 is an exploded perspective view showing the liquid content container having the tension member according to the present invention.
Figure 3:
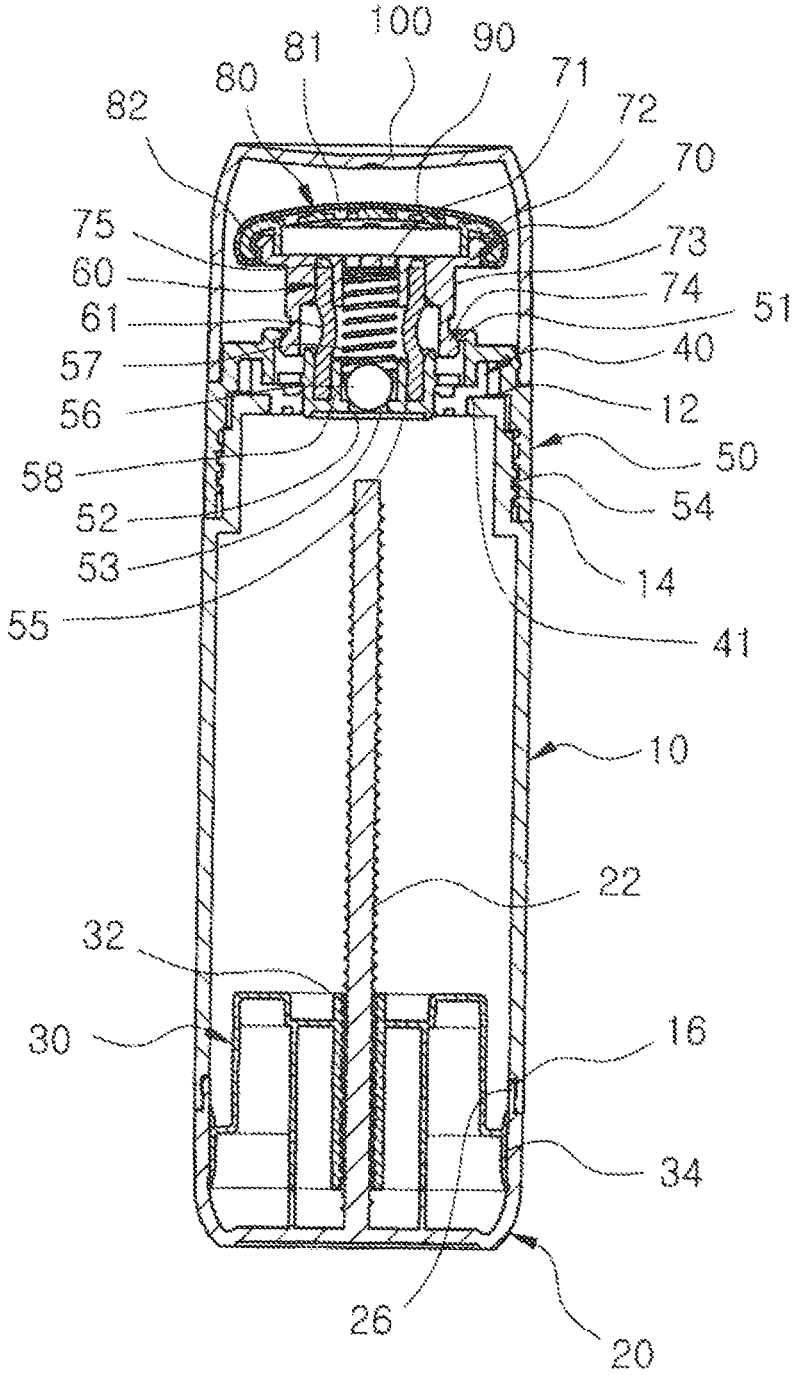
FIG. 3 is an assembling sectional view showing the liquid content container having the tension member according to the present invention.
Figure 4:
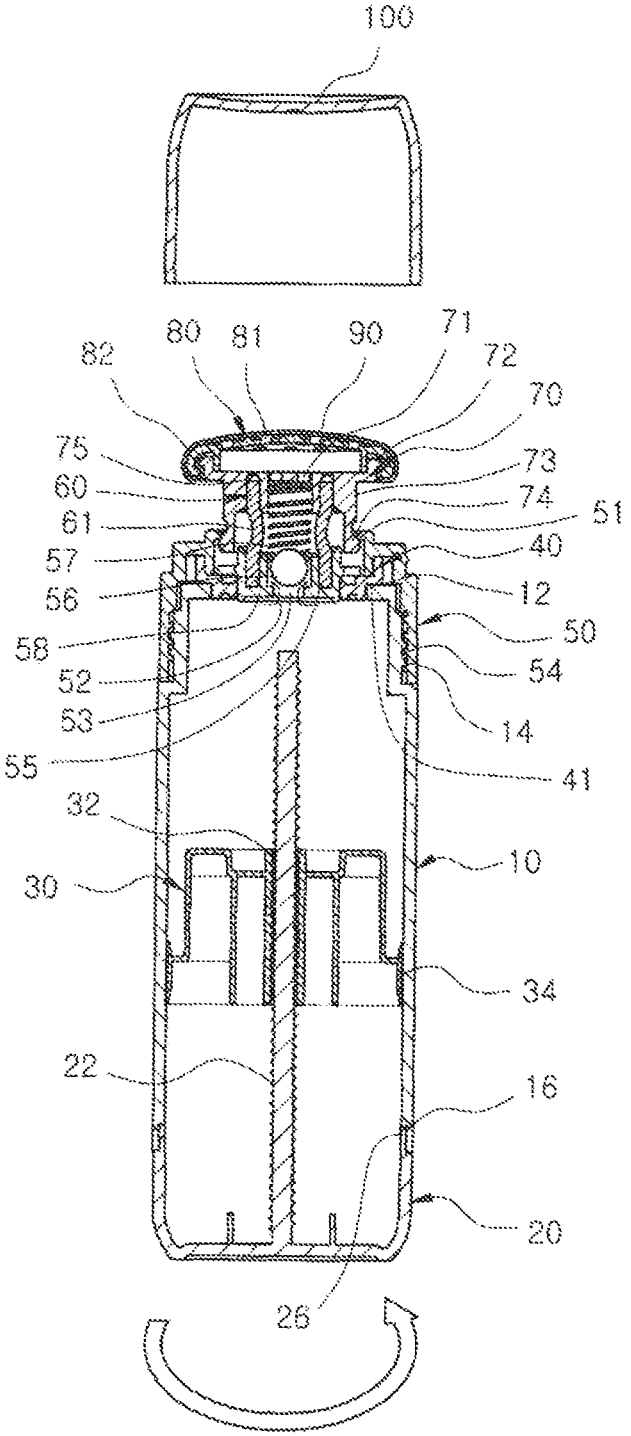
FIG. 4 is a sectional view showing a rotating state of a rotating member after decoupling a container lid from the liquid content container having the tension member according to the present invention.
Figure 5:
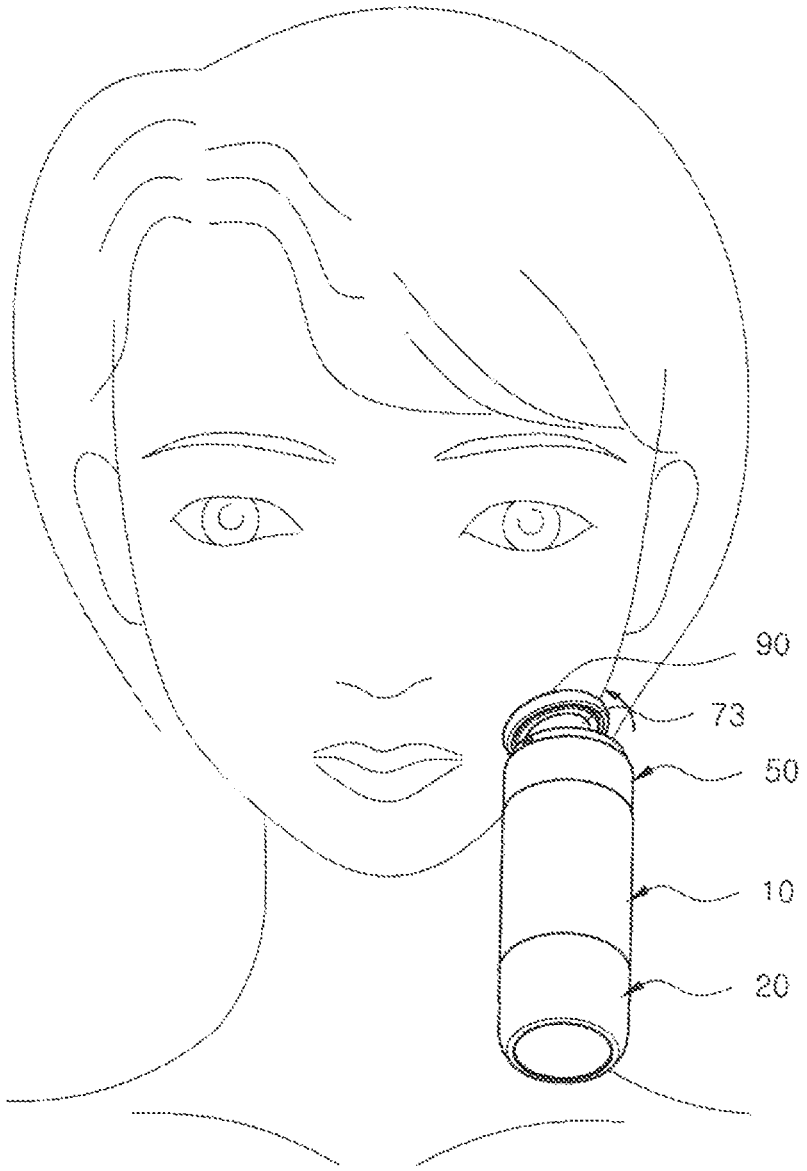
FIGS. 5 and 6 are views showing the use states of the liquid content container having the tension member according to the present invention.
Figure 6:
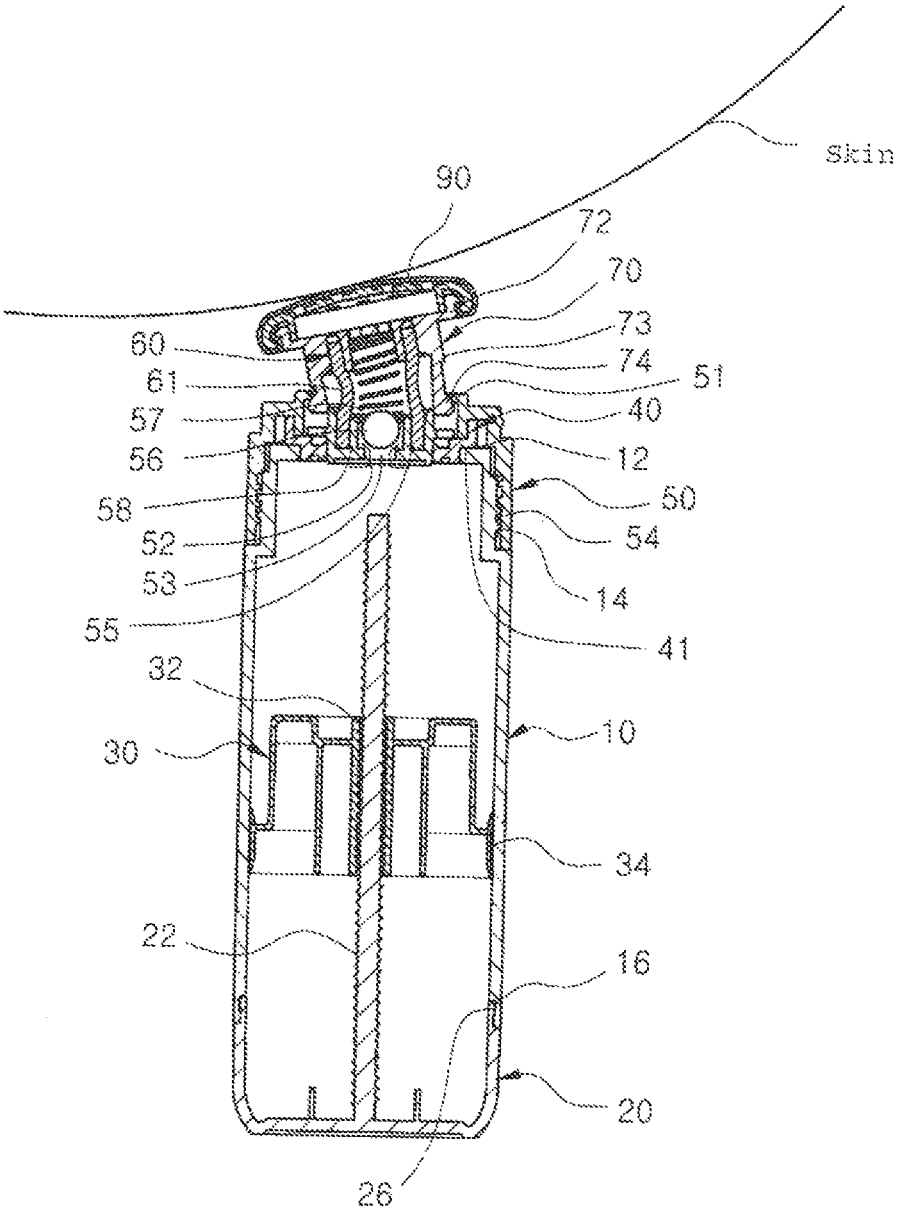

FIG. 1 is an assembling perspective view showing a liquid content container having a tension member according to the present invention. FIG. 2 is an exploded perspective view showing the liquid content container having the tension member according to the present invention. FIG. 3 is an assembling sectional view showing the liquid content container having the tension member according to the present invention. FIG. 4 is a sectional view showing a rotating state of a rotating member after decoupling a container lid from the liquid content container having the tension member according to the present invention. FIGS. 5 and 6 are views showing the use states of the liquid content container having the tension member according to the present invention.

The liquid content container having the tension member according to one embodiment of the present invention includes a container body 10, a rotating member 20 coupled to the container body 10, a piston 30 moving up as the rotating member 20 rotates, an adaptor 40 mounted on an upper end of the container body 10, a shoulder member 50 coupled to the upper end of the container body 10, a tension member 60 mounted on the shoulder member 50, a distribution member 70 coupled to the shoulder member 50, and a discharge member 80 coupled to the distribution member 70.

The container body 10 is formed in an upper portion thereof with an opening 12, and formed at an outer circumferential surface of the upper end thereof with a container body thread 14.

The container body 10 may include a tube-type container squeezable

In this case, the rotating member 20 and the piston 30 are not required.

The adaptor 40 is mounted on an upper end of the opening 12.

In addition, the shoulder member 50 is coupled to the upper end of the container body 10 so that a shoulder member thread 54 formed at an inner side of the shoulder member 50 is screwed with the container body thread 14 formed on an outer side of the container body 10.

The container body 10 is formed in a lower portion thereof with a rotating groove 16 to be coupled to a rotating protrusion 26 of the rotating member 20.

The rotating member 20 is rotatably coupled to the lower end of the container body 10. As shown in FIG. 3, the rotating protrusion 26 of the rotating member 20 is engaged with the rotating groove 16 of the container body 10 in such a manner that the rotating protrusion 26 of the rotating member 20 is rotatably coupled to the rotating groove 16 of the container body 10.

The rotating member 20 is formed at the center thereof with a screw rod 22 to move up the piston 30.

The piston 30 is formed at the center thereof with a screw hole 32, and formed at an outer circumferential surface of a lower end thereof with a piston rib 34 to push up contents.

The screw hole 32 is coupled to the screw rod 22 of the rotating rod 20, so that the piston 30 is moved up when the rotating member 20 rotates.

The piston rib 34 is formed at the outer circumferential surface of the piston 30, and closely makes contact with an inner wall of the container body 10 to push up the contents without leakage. In addition, since the piston rib 34 closely makes contact with the inner wall of the container body 10, the piston 30 is moved up due to the frictional force without rotating along the screw rod 22 when the rotating member 20 rotates.

The adaptor 40 is provided at a lower portion thereof with a stopping circular step 41, and mounted into the opening 12 of the container body 10 to seal the container body 10.

The center of the adaptor 40 makes contact with a housing 58 of the shoulder member 50 to prevent the contents from leaking from the container body 10.

The shoulder member 50 is coupled to the opening 12 formed in the upper end of the container body 10.

The shoulder member 50 is formed on a top surface thereof with stopping steps 51, and formed at the center thereof with a housing 58, and a first mounting groove 55 is formed in an outer portion of the housing 58.

A shoulder member thread 54 is formed at an inner circumferential surface of the lower end of the shoulder member 50 and thus screwed with the container body thread 14 formed at the outer circumferential surface of the upper end of the container body 10.

The stopping step 51 is locked to a stopping protrusion 74 of the distribution member 70 so that the distribution member 70 is locked to the shoulder member 50.

The housing 58 is formed on an inner lower end thereof with a mounting step 52, and an opening and closing member 56 and an elastic member 57 are mounted on the mounting step 52.

The opening and closing member 56 opens or closes an opening/closing hole 53 formed in the center of the lower end of the housing 58 when the contents are discharged oat of the container body 10.

When contents are discharged out of the container body 10 as the rotating member 20 rotates, the opening and closing member 56 receives pressure to move up and thus opens the opening/closing hole 53 so that the contents are discharged. Then, if the pressure is reduced, the opening and closing member 56 closes the opening/closing hole 53 by the elasticity of the elastic member 57.

A container lid 100 is coupled to the shoulder member 50 to prevent a discharge hole in the liquid content container having a tension member 60 according to the present invention from being exposed to the outside.

The first mounting groove 55 is formed in the outer portion of the housing 58, and a lower end of the tension member 60 is fitted into the first mounting groove 55.

The tension member 60 is formed at the center thereof with a recess part 61, and may include at least one of natural rubber, elastomer, silicon rubber, NBR rubber, and synthetic resin having excellent elasticity.

The lower end of the tension member 60 is fitted into the first mounting groove 55 of the shoulder member 50, and the upper end of the tension member 60 is fitted into a second mounting groove 75 of the distribution member 70.

The recess part 61 allows the tension member 60 to be easily bent when the tension member 60 moves.

Since the tension member 60 elastically couples the shoulder member 50 to the distribution member 70, the discharge member 80 moves at a predetermined angle about a central axis of the container body 10 to allow a user to conveniently make up when using the liquid content container having the tension member according to the present invention, and is returned to the original, position thereof due to the elasticity of the tension member 60 after the use thereof.

The distribution member 70 is coupled to the upper end of the shoulder member 70, and formed at a lower portion thereof with a second mounting groove 75, and includes a tension guide 73 having the stopping protrusion 74 locked to the shoulder member 50, a discharge passage 71 to discharge contents, and an annular protrusion 72 coupled, to the discharge member 80.

The second mounting groove 75 is formed in a lower portion, of the distribution member 70 so that the upper end of the tension member 60 is fitted into the second mounting groove 75.

The tension guide 73 integrally extends from the lower end of the distribution member 70 and the stopping protrusion 74 is formed on an outer circumferential surface of a distal end of the tension guide 73.

The tension guide 73 ensures a space where the discharge member 80 moves when the discharge member 80 moves at a predetermined angle due to the tension, member 60.

The stopping protrusion 74 is locked to the stopping step 51 formed on the top surface of the shoulder member 50 to prevent the discharge member 80 from being separated from the shoulder member 50 when the user uses the liquid content container having the tension, member according to the present invention.

The discharge passage 71 is formed in the inner portion of the distribution member 70 to serve as a moving passage of contents when the contents are discharged out of the container body 10. A plurality of discharge passages 71 may be formed to smoothly discharge contents.

The annular protrusion 72 is formed on the upper end of the distribution member 70, and fitted to a protruding ring 82 of the discharge member 80.

The discharge member 80 discharges the contents passing through the distribution member 70, and includes a discharge hole 81 and the protruding ring 82.

The discharge hole 81 is a part through which the contents passing through the distribution, member 70 are discharged to the outside. In order to uniformly discharge the contents, discharge holes 81 may be formed radially from the central axis as shown in FIG. 2.

The user may directly apply the contents passing through the discharge hole 81 on the skin of the user through the top surface of the discharge member 80 having the discharge hole 81, or may use the contents using an additional puff.

In addition, as shown in FIG. 3, a puff sheet 90 may be covered on the surface having the discharge hole 81.

The puff sheet 90 is formed to surround the surface of the discharge member 80 having the discharge hole 81.

In addition, the puff sheet 90 includes at least one of cotton, textile, foam NBR, ruby-cell, and polyester so that contents may smoothly pass through the puff sheet 90 and the user does not feel different when the puff sheet 90 makes contact with the skin of the user. In addition, the puff sheet 90 may be formed of sponge or soft polyurethane foam having elasticity since the puff sheet 90 is covered on the discharge member 80 and fixedly looked to the protruding ring 82.

The protruding ring 82 is fitted around the annular protrusion 72 so that the puff sheet 90 is not separated from the discharge member 80.

A sponge including a porous foam may be additionally interposed between the distribution member 70 and the discharge member 80 so that the liquid phase component and the oil phase component of the contents are mixed together while passing through the sponge even if the contents are divided into the liquid phase component and the oil phase component Hereinafter, a method of assembling the liquid content container having the tension member according to one embodiment of the present invention and the use state of the liquid content container will be described in detail.

According to the present invention, the rotating member 20 having the piston 30 coupled thereto is coupled to the lower end of the container body 10. Thereafter, after injecting the contents into the container body 10, the adaptor 40 is mounted on the upper end of the container body 10, and the shoulder member 50 is screwed with the container body thread 14 of the container body 10. The opening and closing member 56 and the elastic member 57 are sequentially mounted in the housing 58 formed in the center of the shoulder member 50. Next, after the tension member 60 has been fitted into the first mounting groove 55 of the shoulder member 50, the distribution member 70 is fitted into the upper end of the shoulder member 50. The upper end of the tension member 60 is fitted into the second mounting groove 75 of the distribution member 70. The discharge member 80 having the protruding ring 82 to be coupled to the annular protrusion 72 of the distribution member 70 is fitted around the upper end of the distribution member 70. The discharge member 80 has the discharge holes 81 radially formed, so that contents may be applied to the skin of the user directly or using an additional puff. Further, in order for the user to feel soft, the puff sheet 90 may be covered on the discharge member 80 and used as shown in FIG. 3.

In the liquid content container having the tension member, which is assembled as described above, the piston 30 is moved up according to the rotation of the screw rod 22 if the rotating member 20 at the lower end of the container body 10 rotates as shown in FIG. 4. In this case, the piston 30 presses the contents in the container body 10 to open the opening/closing hole 53 closed by the opening and closing member 56 provided in the housing 58 inside the shoulder member 50. Thereafter, the contents are discharged to the discharge holes 81 of the discharge member 80 through the discharge passage 71 of the distribution member 70.

In this case, as shown in FIGS. 5 and 6, as the face of a human being has a curved and 3-D shape, the discharge member 80 may move at a predetermined angle about the center axis in the container body 10 due to the tension member 60 provided under the discharge member 80 when the liquid content container having the tension member according to the present invention is used.

As described above, although a liquid content container having a tension member according to one embodiment of the present invention has been described for the illustrative purpose, the present invention is not limited thereto. Thus, it should foe understood that numerous other modifications and embodiments can be devised by those skilled in the art within the spirit and scope of the present invention and they will fall within the scope of the present invention.

DESCRIPTION OF REFERENCE NUMERALS

10: Container body
12: Opening
14: Container body thread
16: Rotating groove
20: Rotating member
22: Screw rod
26: Rotating protrusion
30: Piston
32: Screw hole
34: Piston rib
40: Adapter
41: Stopping circular step
50: Shoulder member
51: Stopping step
52: Mounting Step
53: Opening and closing hole
54: Shoulder member thread
55: First mounting groove
56: Opening and closing member
57: Elastic member
58: Housing
60: Tension member
61: Recess part
70: Tension member
71: Discharge passage
72: Annular protrusion
73: Tension guide
74: Stopping protrusion
75: Second, mounting step
80: Discharge member
81: Discharge hole
82: Protruding ring
90: Puff sheet
100: Container lid

The invention claimed is:

1. A liquid content container having tension member, the liquid content container comprising:

a container body (10) to receive contents therein;

an adaptor (40) mounted on an upper end of the container body (10);

a shoulder member (50) coupled to the upper end of the container body (10);

the tension member (60) mounted on the shoulder member 50);

a distribution member (70) coupled to the shoulder member (50) by the tension member (60); and a discharge member (80) coupled to the distribution member (70), wherein the tension member (60) is elastic, wherein bending the tension member (60) by a user contact moves the discharge member (80) at a predetermined angle about a central axis of the container body (10) and elasticity of the tension member (60) restores the discharge member (80) to an original position after use of the liquid content container.

2. The liquid content container of claim 1, wherein the container body (10) comprises a rotating member (20) formed at a center thereof with a screw rod (22) and a piston (30) moving up as the rotating member (20) rotates.

3. The liquid content container of claim wherein the shoulder member (50) is formed in a center thereof with a housing (58).

4. The liquid content container of claim 3, wherein an opening and closing member (56) and an elastic member (57) are mounted in the housing (58).

5. The liquid content container of claim 1, wherein the tension member (60) comprises a recess part (61).

6. The liquid content container of claim 1, wherein the distribution member (70) is formed at a lower portion thereof with a tension guide (73).

7. The liquid content container of claim 1, wherein the discharge member (80) comprises a discharge hole (81) and a protruding ring (82).

8. The liquid content container of claim 1, wherein the discharge member (80) is provided at an outer circumferential surface of an upper end thereof with a puff sheet (90).

9. A liquid content container having a tension member, the liquid content container comprising container body (10) having an upper end on which an adaptor (40) is mounted, wherein a shoulder member (50) is coupled to the upper end of the container body (10), the tension member (60) and a distribution member (70) are coupled to the shoulder member (50) through fitting, and a discharge member (BO) is fitted around an upper end of the distribution member (70), wherein the tension member (60) elastically couples the shoulder member (50) to the distribution member (70), wherein the tension member (60) is elastic, wherein bending the tension member (60) by a user contact moves the discharge member (80) at a predetermined angle about a central axis of the container body (10) and elasticity of the tension member (60) restores the discharge member (80) to an original position after use of the liquid content container.

* * * * *